United States Patent [19]

Ertl

[11] 4,152,874

[45] May 8, 1979

[54] TELEPHONE BOOTH MOUNTING ARRANGEMENT

[75] Inventor: Edward S. Ertl, McHenry, Ill.

[73] Assignee: Acoustics Development Corporation, Northbrook, Ill.

[21] Appl. No.: 876,756

[22] Filed: Feb. 10, 1978

[51] Int. Cl.[2] ..... E04F 19/00

[52] U.S. Cl. ..... 52/27; 179/183

[58] Field of Search ..... 52/36, 27; 248/203, 248/125, 27.1; 179/183, 189 R

[56] References Cited

U.S. PATENT DOCUMENTS

| | | | |
|---|---|---|---|
| 3,164,868 | 1/1965 | Hannula et al. | 52/36 |
| 3,398,244 | 8/1968 | Ertl et al. | 248/203 X |
| 3,511,941 | 5/1970 | Quigley | 52/36 X |
| 3,845,590 | 11/1974 | Ertl | 52/36 |
| 4,067,151 | 1/1978 | Drakulic | 52/27 |

*Primary Examiner*—Price C. Faw, Jr.
*Assistant Examiner*—Carl D. Friedman
*Attorney, Agent, or Firm*—Kinzer, Plyer, Dorn & McEachran

[57] ABSTRACT

A telephone booth construction utilizes a telephone mounting bracket and a telephone mounting cover. There are multiple screw holes in both the mounting bracket and the mounting cover and the holes are so arranged that the mounting bracket may be attached in two different positions on a wall of the booth. The mounting cover which has a telephone mounting opening may similarly be attached in two different positions on the mounting bracket, which different positions involve only the reversal of the mounting cover and provide for two different mounting heights for the telephone.

7 Claims, 2 Drawing Figures

18
50a
22
16
50b
14
10
24
66
28
50d
20
46a
48a
26
42
48b
36
46b
52b
40
34
36
42
48c
46c
48d
42
52d
46d
12
30
32
64
62
54a
54
54c
58
54b
56
38
60
54d
68

TELEPHONE BOOTH MOUNTING ARRANGEMENT

SUMMARY OF THE INVENTION

The present invention relates to telephone booths and in particular to a simplified booth construction which provides for mounting the telephone at different heights without any change in the mounting members or booth height.

A primary purpose of the invention is a telephone booth construction in which the telephone may be mounted at different heights with only a reversal or relocation of existing mounting parts.

Another purpose is a simplified telephone booth construction which eliminates stocking of various size booths and different mounting parts.

Another purpose is a telephone booth construction permitting differing telephone mounting arrangements without any change in parts.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

There are a great variety of mounting arrangements for telephone booths, depending upon whether the user will be sitting, standing or perhaps in an automobile. The booth itself may be mounted on a wall, on a post, or to a central support common to several booths. It is highly desirable in the manufacture of booths to standardize as much as possible to eliminate the necessity of inventorying a large number of different parts. The present invention is specifically directed to a telephone booth in which the telephone may be mounted at two different heights but without any change in mounting parts.

Figure 1:
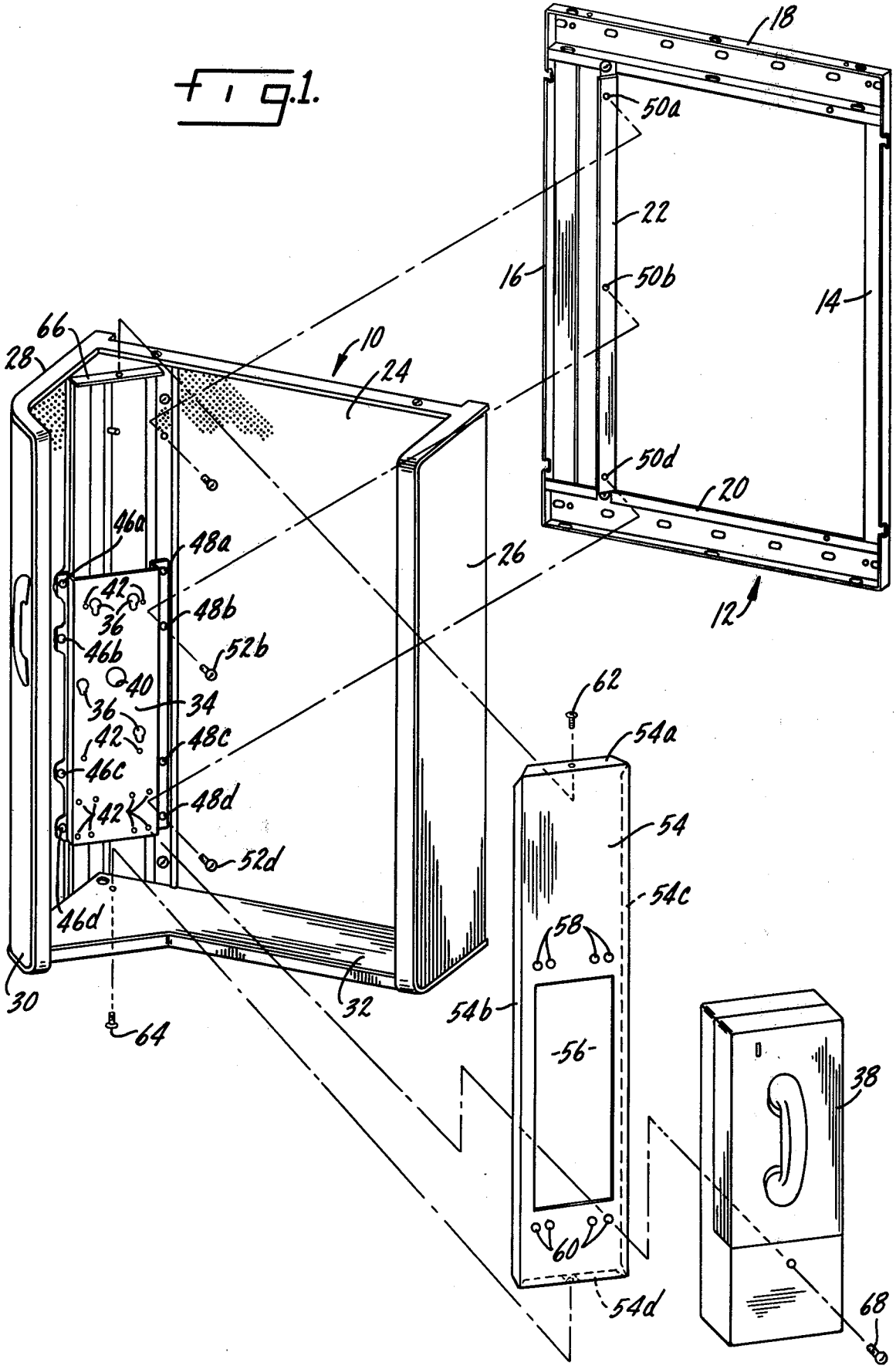
FIG. 1 is an exploded perspective illustrating a telephone booth, a wall mounting bracket, and the various parts utilized to mount the telephone to the booth.

In FIG. 1 a telephone booth is indicated generally at 10 and may be similar to that shown in U.S. Pat. No. 3,164,868 and in a recently filed design patent application, Ser. No. 801,517, assigned to the assignee of the present application. A mounting bracket 12 may be similar to that shown in U.S. Pat. No. 3,164,868 and includes upright frame members 14 and 16, top and bottom frame members 18 and 20, respectively, and a diagonal member 22 which extends between and is fastened to top and bottom frame members 18 and 20.

Booth 10 may include a back 24, a side wall 26 attached to the right-hand side of the back, as shown in the drawings, and a side wall 28 attached to the left side of back 24 and having an inwardly-curved front portion 30. A lower shelf 32 is connected to the side walls and back and generally completes the booth structure. The walls and back of the booth may be made of or include an acoustic material, although this is not essential.

A telephone mounting bracket 34 which may be similar to that shown in U.S. Pat. No. 3,398,244 is attached to booth 10 at the corner where wall 28 meets back 24.

Mounting bracket 34 may have a plurality, for example 4, keyhole-shaped openings 36 which will receive the security studs on a coin telephone indicated at 38 to securely fasten the telephone to the mounting bracket. There is a central opening 40 which will be used to provide wire access to the telephone 38 and there are mounting holes 42 to mount the telephone. Holes 42 are used to attach the mounting cover and the telephone, in combination, to the mounting bracket.

FIG. 1 shows the attachment of the mounting bracket to mount the telephone coin slot 54 inches above the floor. Bracket 34 has two vertical rows of mounting holes, with each row being formed in a side flange of the mounting bracket. The holes are designated as row 46 on the left with holes **46*a*–46*d* and row 48 on the right with holes 48*a*–48*d*. In the 54-inch mounting arrangement of FIG. 1, holes 48*b* and 48*d* are used in mounting the bracket to wall mounting bracket 12. Fasteners 52*b* and 52*d* pass through the designated mounting bracket holes and then into holes 50*b* and 50*d* in wall mounting bracket 12. A third wall mounting bracket hole 50*a* receives a fastener 52*a* which is also used in attaching the booth to the wall mounting bracket. Thus, the screws that mount the telephone mounting bracket also mount the booth to the wall mounting bracket. Holes 46*b* and 46*d* will receive fasteners which attach the left side of the telephone mounting bracket to booth wall 28**.

A telephone mounting cover 54 has a top flange **54*a*, side flanges 54*b* and 54*c* and a bottom flange 54*d*. Mounting cover 54 has an opening 56 and two rows of mounting holes 58 and 60 at the top and bottom of the opening. When the telephone mounting cover is positioned in the booth, fasteners 62 and 64 are used to hold top and bottom flanges 54*a* and 54*d* to the booth, with top flange 54*a* resting on top of a small flange 66 fastened to the booth structure. Fastening screws 68 will pass through telephone 38, through mounting holes 60 and opening 56 on the cover and into mounting bracket holes 42. The telephone will mask opening 56 and it will mask the unused row of mounting holes 58. Thus, screws 68** which mount the telephone to the telephone mounting bracket also mount or attach the mounting cover to the telephone mounting bracket.

Figure 2:
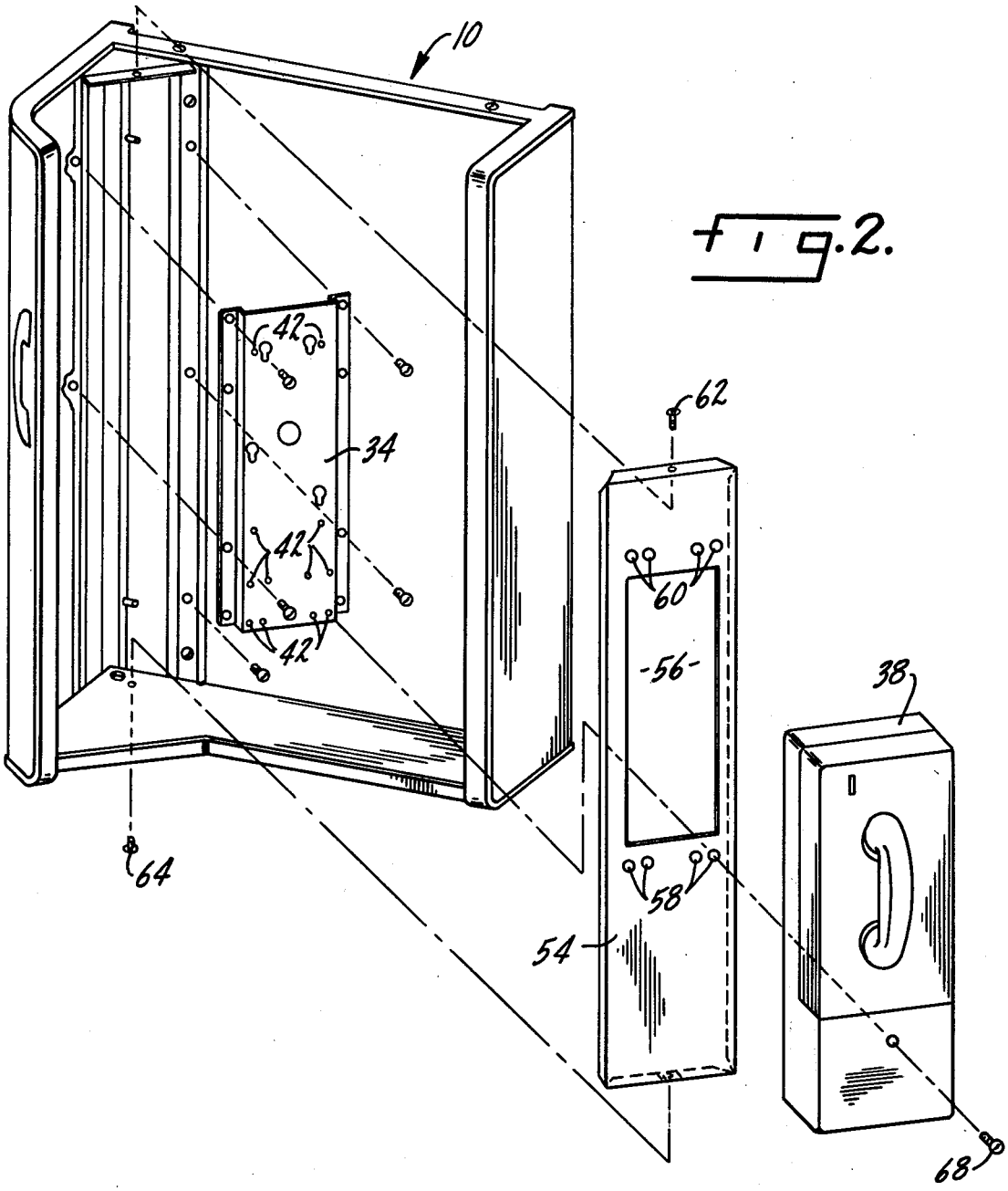
FIG. 2 is an exploded perspective, similar to FIG. 1, but showing the mounting bracket and mounting cover in a second position for mounting the telephone.

In the arrangement of FIG. 2, the parts are all identical to those in FIG. 1. However, in this case, telephone mounting bracket 34 is attached to the booth through the use of holes **46*a* and 46*c* and 48*a* and 48*c*. Fasteners 52 pass through the top and next-to-bottom holes designated and then into the booth structure on the right and into the wall mounting bracket on the left. Again, the same screws that are used to fasten the telephone mounting bracket to the booth are used to fasten the booth to the wall mounting bracket. However, in this case the lowermost hole 50*d* of the wall mounting bracket does not receive a fastener that holds the telephone mounting bracket. Instead the screw passing into opening 50*d*** goes directly through the booth into the wall mounting bracket.

In the FIG. 2 configuration the telephone mounting cover 54 has been turned over so that the opening which was formerly adjacent the bottom of the rectangular mounting cover is now adjacent the top. Assuming the booth is mounted the same height from the floor as in FIG. 1, which is the desired way to mount the booth, the telephone coin slot will now be 63 inches above the floor. Screws 68 which are used to fasten the telephone and the mounting cover to the mounting bracket again pass through holes 42 of the mounting bracket.

The mounting arrangements of FIGS. 1 and 2 use identical parts. In the lowermost mount the mounting bracket is attached by the use of certain designated holes, whereas, in the higher mount a different set or different selected holes or openings are used in attaching the mounting bracket to the booth. In the higher mounting arrangement of FIG. 2 the mounting bracket is positioned above its point of attachment in FIG. 1 and the telephone mounting cover has been reversed so that the opening is closer to the top of the mounting cover than to the bottom. The same screws may be used to fasten the telephone and mounting cover to the mounting bracket. They just pass through different holes in the mounting cover.

It is important in the inventory of telephone booths to eliminate different parts for different mounting arrangements. The present arrangement provides a booth which can mount a telephone at two different heights without any change in the booth mounting arrangement or without any different mounting parts. The telephone mounting cover and mounting bracket have holes predrilled at precise locations so that both elements can be mounted in two different positions. The mounting bracket may be mounted in a lower or upper position and the cover is simply reversed from one position to another in order to provide different telephone mounting heights.

Although mounting heights of 63 and 54 inches have been described herein, it should be obvious that although such mounting heights are common, they form no part of the invention and are basically for illustration.

Whereas the preferred form of the invention has been shown and described herein, it should be realized that there may be many modifications, substitutions and alterations thereto.

The embodiments of the invention in which an exclusive property or privilege is claimed are as follows:

1. A telephone booth construction including a telephone booth having wall means, a telephone mounting bracket having a group of mounting holes therein, screw means using selected ones of said mounting holes for attaching said mounting bracket in a first position to said wall means or using other selected ones of said mounting holes for attaching said mounting bracket in a second position to said wall means, said mounting bracket being substantially shorter than the wall means to which it is attached, a telephone mounting cover having an opening therein and two sets of telephone mounting holes adjacent said opening, said mounting cover extending generally between the top and bottom of said booth, and screw means for mounting a telephone and said mounting cover to said mounting bracket, one set of cover mounting holes being used to attach the telephone and cover in a first position corresponding with said bracket first position and the other set of cover mounting holes being used, with a reversal of cover position, to mount the telephone and said cover in a second position on said mounting bracket.

2. The structure of claim 1 further characterized in that said mounting cover is generally rectangular in shape, with said opening being closer to one end than the other.

3. The structure of claim 2 further characterized in that said opening is generally rectangular in shape with said cover mounting holes being positioned generally adjacent the short sides of said access opening.

4. The structure of claim 1 further characterized in that in said first position of said mounting cover the opening is closer to the bottom than the top and in said second position said opening is closer to the top than to the bottom.

5. The structure of claim 1 further characterized by and including a wall mounting bracket for positioning said telephone booth on a wall, at least a portion of the screw means for attaching said mounting bracket extend through said telephone booth into said wall bracket.

6. The structure of claim 1 further characterized in that there are two rows of mounting holes in said mounting bracket, said screw means passing through alternate openings in each row in said first position and through different alternate openings in each row in said second position.

7. The structure of claim 6 further characterized in that bracket mounting holes are arranged in two vertical rows along opposite edges of said bracket.

* * * * *